US007226180B2

(12) United States Patent
Sung

(10) Patent No.: US 7,226,180 B2
(45) Date of Patent: Jun. 5, 2007

(54) PAIR OF SHINING SWIMMING GOGGLES

(76) Inventor: Hsiu-Ying Sung, P.O. Box 26-757, Taipei 106 (TW)

( * ) Notice: Subject to any disclaimer, the term of this patent is extended or adjusted under 35 U.S.C. 154(b) by 1 day.

(21) Appl. No.: 11/208,403

(22) Filed: Aug. 22, 2005

(65) Prior Publication Data

US 2007/0041176 A1 Feb. 22, 2007

(51) Int. Cl.
*F21V 21/84* (2006.01)

(52) U.S. Cl. ..... 362/105; 482/55; 351/43; 351/148; 2/426; 2/440; 2/452

(58) Field of Classification Search ..... 362/105; 482/55; 351/43, 148; 2/426, 440, 452
See application file for complete search history.

(56) References Cited

U.S. PATENT DOCUMENTS 5,585,871 A * 12/1996 Linden ..... 351/158
5,697,792 A * 12/1997 Ladin ..... 434/254
2002/0176323 A1* 11/2002 Magine et al. ..... 367/134
2005/0276037 A1* 12/2005 Kuo ..... 362/105

* cited by examiner

*Primary Examiner*—Renee Luebke
*Assistant Examiner*—Mary Zettl
(74) *Attorney, Agent, or Firm*—Rosenberg, Klein & Lee

(57) ABSTRACT

A pair of shining swimming goggles comprises a pair of swimming goggles, a shining module and an electric conducting portion. The shining module is embedded in an inner portion of the swimming goggles. The electric conducting portion is disposed on a surface of the swimming goggles. The electric conducting portion is electrically connected to the shining module, thereby when the swimming goggles are placed in water, the electric conducting portion conducts electricity to the shining module by water to make the shining module shine for showing the position of the swimmer.

6 Claims, 4 Drawing Sheets

PAIR OF SHINING SWIMMING GOGGLES

BACKGROUND OF THE INVENTION

1. Field of the Invention

The present invention relates to a pair of shining swimming goggles, and more particularly, to a pair of swimming goggles that will shine in water.

2. Description of the Related Art

Referring to FIG. 1, a pair of conventional swimming goggles comprises two lens bodies 1*a*, two linings 13*a*, a bridge component 2*a* and a goggles band 3*a*.

The lens bodies 1*a* are made of transparent or translucent plastic material, and are left and right symmetric. Lock ears 15*a* are provided at the adjacent ends of the left and right lens bodies 1*a*. Each of the lens bodies 1*a* has a lens portion 11*a*. Side frame portions 12*a* extend from the peripheries of the lens portions 11*a* to the eye socket-sticking sides of the swimming goggles. Goggles band holes 14*a* are provided at the side frame portions 12*a* at the distant ends of the left and right lens bodies 1*a*.

Two ends of the bridge component 2*a* are connected to the adjacent ends of the two lens bodies 1*a*. The two ends of the bridge component 2*a* pass through the lock ears 15*a* of the left and right lens bodies 1*a* and fasten thereon for adjusting the distance between the two lens bodies 1*a*.

Two ends of the goggles band 3*a* pass through and are connected to the goggles band holes 14*a* at the distant ends of the two lens bodies 1*a*.

However, the above-mentioned conventional swimming goggles do not provide a light source that allows the position of the swimmer in water to be observed easily. If a swimmer has an accident in water, it is difficult for a lifesaver to locate the swimmer straight away. In order to ensure the swimmer's security, it is necessary to embed a shining module in the swimming goggles so that a lifeguard can quickly ascertain the position of the swimmer.

Therefore, the conventional swimming goggles are limited by its design in only protecting a swimmer's eyes. It does not provide a function for showing the swimmer's position to preserve their life and safety.

SUMMARY OF THE INVENTION

It is therefore a principal object of the present invention to provide a pair of shining swimming goggles, which shine in water, for showing the swimmer's position to preserve their life and safety.

To achieve the above object, one feature of the present invention is a pair of shining swimming goggles, comprising a pair of swimming goggles, a shining module embedded in an inner portion of the swimming goggles, and an electric conducting portion disposed on a surface of the swimming goggles and electrically connected to the shining module. Thereby when the swimming goggles are in water the electric conducting portion conducts power to the shining module, and the shining module shining shows the position of the swimmer.

To provide a further understanding of the invention, the following detail description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
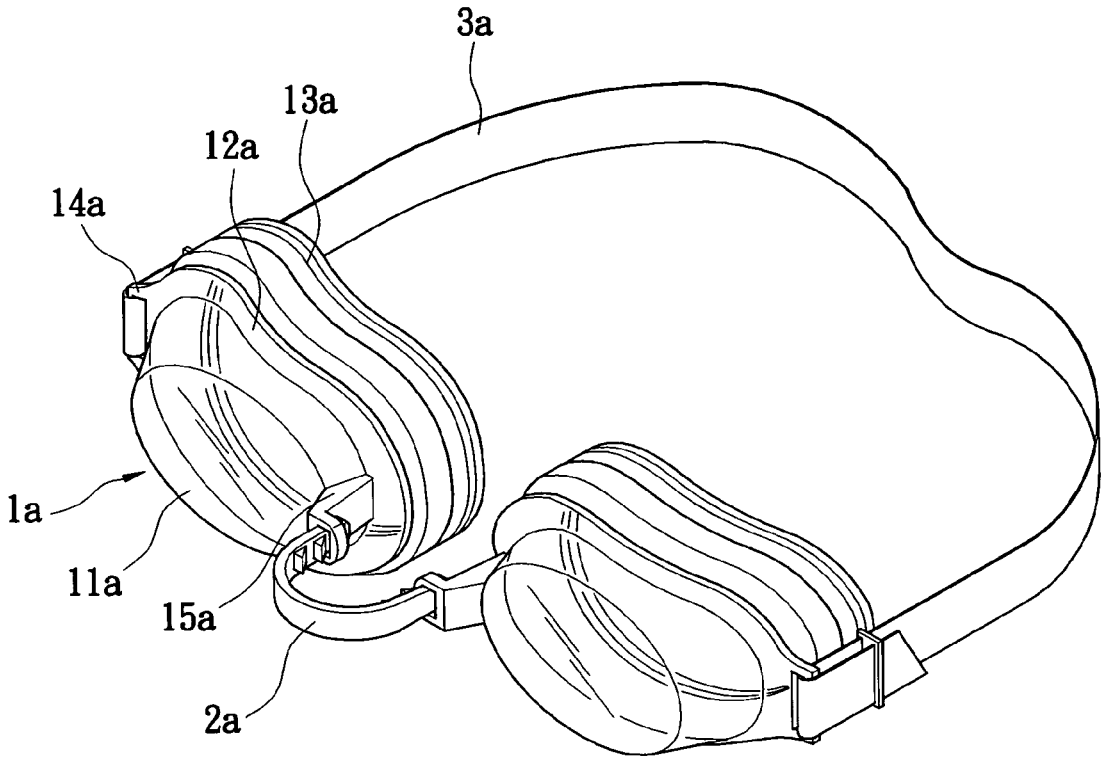
FIG. 1 PRIOR ART
FIG. 1 is a combination view of the conventional swimming goggles.

Referring now to the drawings wherein the showings are for purposes of illustrating preferred embodiments of the present invention only, and not for purposes of limiting the same.

Figure 2:
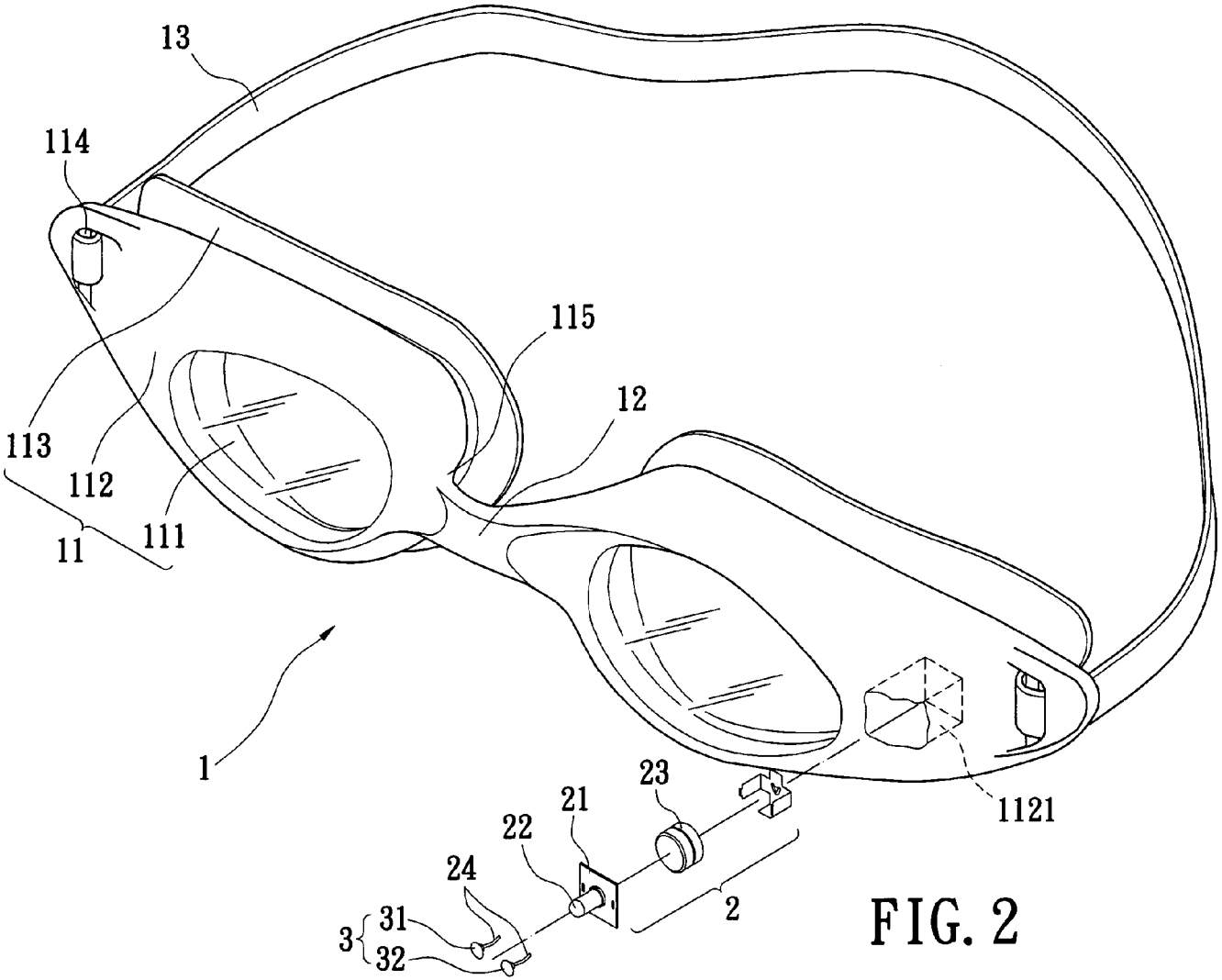
FIG. 2 is a partial exploded view of the shining swimming goggles in accordance with a preferred embodiment of the present invention.
Figure 3:
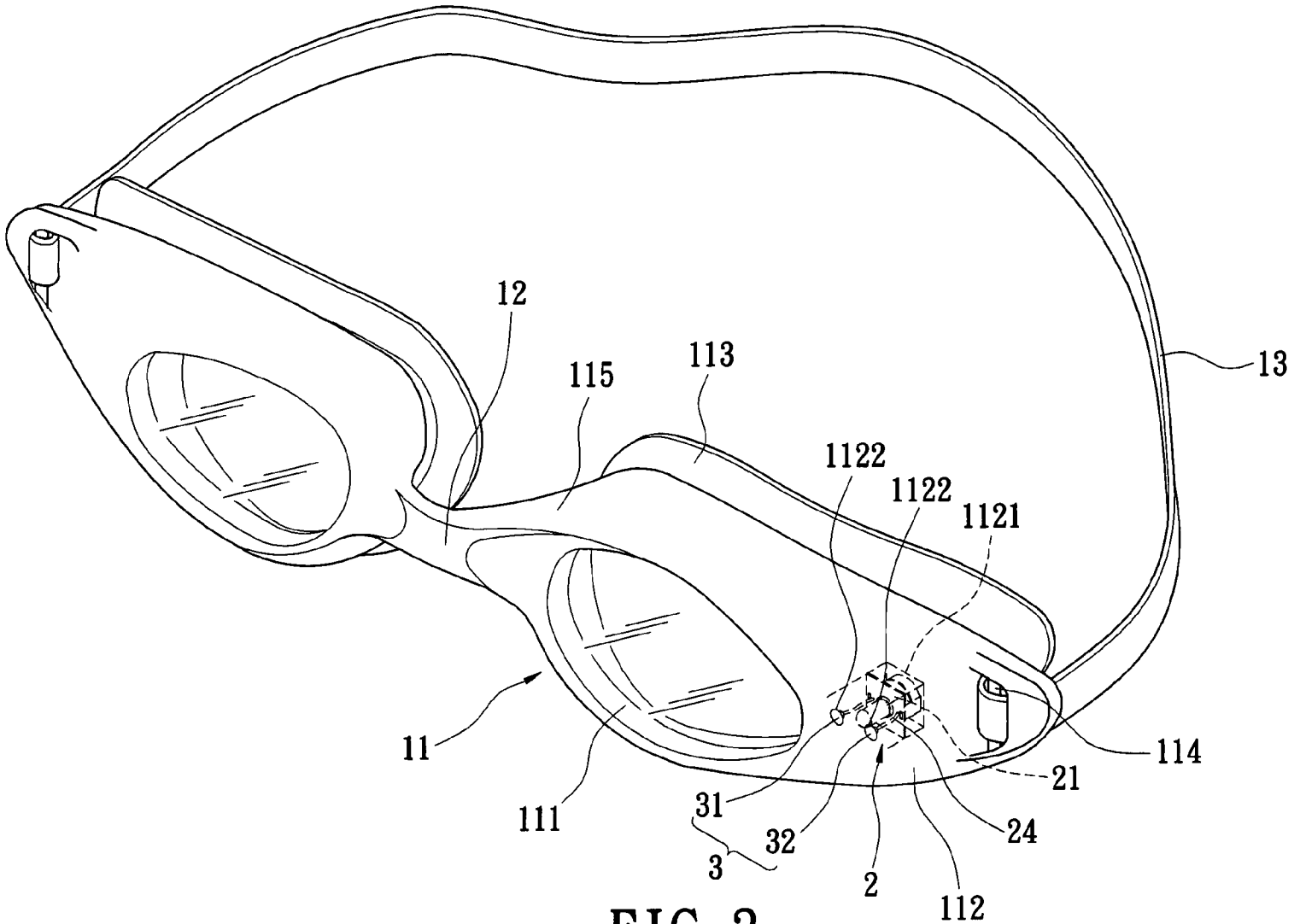
FIG. 3 is a combination view of the shining swimming goggles in accordance with a preferred embodiment of the present invention.

Referring to the drawings, and initially to FIGS. 2-3, a pair of shining swimming goggles in accordance with a preferred embodiment of the present invention comprises a pair of swimming goggles 1, a shining module 2 and an electric conducting portion 3. The shining module 2 is embedded in an inner portion of the swimming goggles 1. The electric conducting portion 3 has a first conducting portion 31 and a second conducting portion 32. The first conducting portion 31 and the second conducting portion 32 are respectively disposed on a surface of the swimming goggles 1 and electrically connected to the shining module 2. Thereby when the swimming goggles 1 are placed in water they cause the electric conducting portion 3 to conduct power, and the shining module 2 shines for showing the position of a swimmer.

The swimming goggles 1 comprise a pair of lens bodies 11, a bridge component 12 and a headband 13. The two lens bodies 11 are left and right symmetric. Each of the two lens bodies 11 further comprises a lens portion 111, a side frame portion 112 and a pad 113. The side frame portion 112 is integrally formed on the periphery of the lens portion 111. The pad 113 is disposed on one side of the periphery of the side frame portion 112. The side frame portion 112 has a receiving space 1121 at an inner portion thereof. And the side frame portion 112 has two apertures 1122 on the surface thereof. Each of the two apertures 1122 is disposed in the receiving space 1121. The receiving space 1121 is provided for the shining module 2 to be disposed therein. The two apertures 1122 are provided respectively for the first conducting portion 31 and the second conducting portion 32 of the electric conducting portion 3 to join together tightly therein. Two first fixing portions 114 are provided at the side frame portions 112 at the distant ends of the left and right lens bodies 11. Two second fixing portions 115 are provided at the side frame portions 112 at the adjacent ends of the left and right lens bodies 11. The two ends of the bridge component 12 are connected respectively to the two second fixings 115. The two ends of the headband 13 are connected respectively to the two first fixings 114.

The shining module 2 is embedded in the receiving space 1121. The shining module 2 includes a circuit unit 21, a shining element 22 and a power source 23. The circuit unit 21 is a PCB. The circuit unit 21 is electrically connected to the first conducting portion 31 and the second conducting portion 32 through two conducting wires 24 respectively. The shining element 22 is an LED. The positive pole and the negative pole of the LED are respectively electrically connected to the circuit unit 21. The power source 23 is an electric cell. The electric cell can be an alkaline cell. The positive pole and the negative pole of the electric cell are respectively electrically connected to the circuit unit 21 for providing electric power to the shining element 22 for shining.

The first conducting portion 31 and the second conducting portion 32 of the electric conducting portion 3 are the place the electric current of the negative pole flows through respectively. The first conducting portion 31 is electrically connected to the negative pole of the electric cell. The second conducting portion 32 is electrically connected to the negative pole of the LED. In the other words, the first conducting portion 31 and the second conducting portion 32 are formed through cutting off the circuit the electric current of the negative pole flows through. Therefore, the first conducting portion 31 and the second conducting portion 32 form a passageway of current to connect with each other.

The first conducting portion 31 of the electric conducting portion 3 is joined tightly in one of the two apertures 1122. One side face of the first conducting portion 31 is exposed on the surface of the side frame portion 112. The other side face of the first conducting portion 31 is exposed to the receiving space 1121 and electrically connected to the negative pole of the power source 23 through the conducting wire 24. The second conducting portion 32 of the electric conducting portion 3 is joined tightly in another one of the two apertures 1122. One side face of the second conducting portion 32 is exposed on the surface of the side frame portion 112. The other side face of the second conducting portion 32 is exposed to the receiving space 1121 and electrically connected to the negative pole of the shining element 22 through the conducting wire 24.

In addition, the first conducting portion 31 and the second conducting portion 32 of the electric conducting portion 3 can also be the place the electric current of the positive pole flows through respectively. The first conducting portion 31 is electrically connected to the positive pole of the electric cell. The second conducting portion 32 is electrically connected to the positive pole of the LED. In the other words, the first conducting portion 31 and the second conducting portion 32 are formed through cutting off the circuit the electric current of the positive pole flows through. Therefore, the first conducting portion 31 and the second conducting portion 32 form a passageway for current to connect with each other.

When a swimmer puts on the swimming goggles 1 and dives into water, the first conducting portion 31 and the second conducting portion 32 will conduct through the water and make the shining module 2 shine. If the swimmer has an accident in the water, a lifesaver can find the swimmer immediately.

Figure 4:
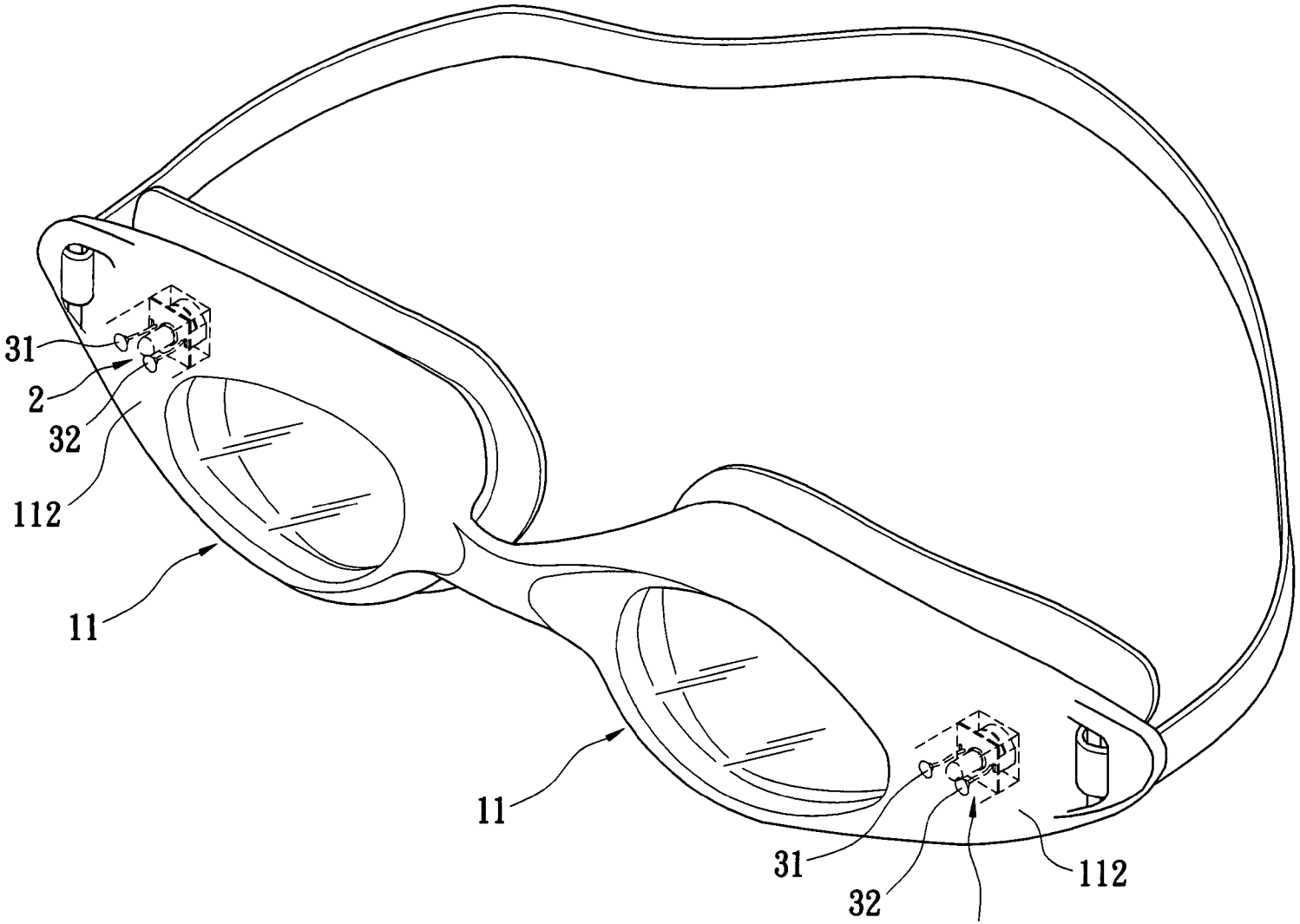
FIG. 4 is a combination view of the shining swimming goggles in accordance with other one preferred embodiment of the present invention.

Referring to the drawings, and finally to FIG. 4, which is the combination view of the shining swimming goggles in accordance with another preferred embodiment of the present invention. Two shining modules 2 are embedded in the side frame portion 112 of the left and right of the two lens bodies 11 respectively to form two symmetric shining sources, thereby the two symmetric shining sources intensify the light to increase the chances that the swimmer can be spotted in the water.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A pair of shining swimming goggles comprising:

a pair of swimming goggles having a pair of side frames, at least one of said side frames having two apertures formed through a front face thereof;

a shining module embedded in a receiving space formed in a rear of said at least one side frame of the swimming goggles, the shining module including a light source directed to emit light from said front face of said at least one side frame; and a pair of electric conducting portions disposed on a surface of said at least one side frame and having respective conducting wires passing through said apertures of the at least one side frame and being electrically connected to the shining module; thereby when the swimming goggles are placed in water they cause the electric conducting portions to conduct electricity, and the shining module shines for showing a position of a swimmer in the water.

2. The shining swimming goggles according to claim 1, wherein the shining module includes a circuit board electrically connected to said conducting wires of the electric conducting portions; said light source being electrically connected and mounted to the circuit board; and a power source electrically connected and mounted to the circuit board for providing electric power to the light source so that it shines.

3. The shining swimming goggles according to claim 2, wherein the light source is an LED.

4. The shining swimming goggles according to claim 2, wherein the power source is an electric cell.

5. The shining swimming goggles according to claim 2, wherein the electric conducting portion has a first conducting portion and a second conducting portion, the first conducting portion is electrically connected to a negative pole of the power source, and the second conducting portion is electrically connected to a negative pole of the light source.

6. The shining swimming goggles according to claim 2, wherein the electric conducting portion has a first conducting portion and a second conducting portion, the first conducting portion is electrically connected to a positive pole of the power source, and the second conducting portion is electrically connected to a positive pole of the light source.

* * * * *